US008403768B2

(12) United States Patent
Aittola

(10) Patent No.: US 8,403,768 B2
(45) Date of Patent: Mar. 26, 2013

(54) GOLF PUTTING PRACTICE BALL

(76) Inventor: Timo Aittola, Stamford, CT (US)

( * ) Notice: Subject to any disclaimer, the term of this patent is extended or adjusted under 35 U.S.C. 154(b) by 355 days.

(21) Appl. No.: 12/845,378

(22) Filed: Jul. 28, 2010

(65) Prior Publication Data

US 2012/0028726 A1 Feb. 2, 2012

(51) Int. Cl.
*A63B 69/36* (2006.01)

(52) U.S. Cl. ..... 473/280; 473/200; 473/351

(58) Field of Classification Search ..... 473/198, 473/200, 219, 268, 280, 351, 377
See application file for complete search history.

(56) References Cited

U.S. PATENT DOCUMENTS

| | | | | | |
|---|---|---|---|---|---|
| 676,506 | A | * | 6/1901 | Knight et al. | 473/268 |
| 1,242,832 | A | | 10/1917 | Martin et al. | |
| 1,842,944 | A | * | 1/1932 | O'Brien | 473/200 |
| 2,709,595 | A | | 5/1955 | Vries | |
| 2,884,254 | A | | 4/1959 | Miner | |
| 3,331,605 | A | | 7/1967 | Special | |
| 3,753,565 | A | | 8/1973 | Baker | |
| 3,951,414 | A | | 4/1976 | Nunez | |
| 4,209,172 | A | | 6/1980 | Yamamoto | |
| 4,235,441 | A | | 11/1980 | Ciccarello | |
| 4,258,921 | A | * | 3/1981 | Worst | 473/268 |
| 4,441,716 | A | | 4/1984 | Chen | |
| 4,546,975 | A | | 10/1985 | Nims | |
| 4,664,387 | A | | 5/1987 | Tardiff | |
| 5,013,046 | A | | 5/1991 | Koch | |
| 5,067,719 | A | | 11/1991 | Mook | |
| 5,564,707 | A | | 10/1996 | Dinh | |
| 5,662,530 | A | | 9/1997 | Sellar | |
| 5,713,799 | A | * | 2/1998 | Balmat | 473/200 |
| 5,716,283 | A | | 2/1998 | Simpson et al. | |
| 5,984,806 | A | | 11/1999 | Sullivan et al. | |
| 6,004,223 | A | | 12/1999 | Newcomb | |
| 6,231,459 | B1 | | 5/2001 | Pettigrew et al. | |
| 6,364,783 | B1 | * | 4/2002 | Kellogg et al. | 473/2 |
| 6,739,980 | B2 | | 5/2004 | Scott et al. | |
| 6,837,814 | B2 | * | 1/2005 | Thomas | 473/613 |
| D501,900 | S | | 2/2005 | Gammon, Jr. | |
| 6,852,039 | B2 | * | 2/2005 | Pettigrew et al. | 473/280 |
| 6,929,567 | B2 | | 8/2005 | Sullivan et al. | |
| 6,988,961 | B2 | | 1/2006 | Nesbitt | |
| D528,176 | S | * | 9/2006 | Milliken | D21/713 |
| 7,134,966 | B1 | | 11/2006 | Tice | |
| D544,930 | S | * | 6/2007 | Farrell | D21/713 |
| 2006/0035723 | A1 | | 2/2006 | Chapman | |
| 2006/0293113 | A1 | * | 12/2006 | Pelz | 473/280 |
| 2008/0096691 | A1 | | 4/2008 | Kang | |

* cited by examiner

*Primary Examiner* — Nini Legesse
(74) *Attorney, Agent, or Firm* — St. Onge Steward Johnston & Reens LLC

(57) ABSTRACT

A golf putting practice ball having visually contrasting lighter and darker sections and a visually contrasting aiming line going across a lighter color section in a 90 degree angle to the borderline of the lighter and darker color sections, and a visually contrasting mark located on the border of the different color sections of the ball, at a location 90° away from the midpoint of the aiming line, and a weight located in an asymmetric position in relation to the internal center of the ball.

19 Claims, 10 Drawing Sheets

GOLF PUTTING PRACTICE BALL

FIELD OF THE INVENTION

The present invention relates to the game of golf; and more specifically, to a golf practice ball designed for players in search of improved putting skills.

BACKGROUND OF THE INVENTION

Golf is a challenging game requiring a golfer to dedicate time to practice. Putting is one of the most difficult parts of the sport. To putt well consistently is very difficult. A good putt requires the player to strike the ball with his/her a putter in the desired direction with a stroke of proper speed. Achieving this requires an accelerating smooth and continuing stroke through the ball. A good stroke swings through the original ball position while the golfer barely perceives the impact of the club with the ball. Many golfers have difficulties in aligning their putts and making a smooth putting stroke.

It is generally accepted that a correct execution of a putt requires the face of the putter to be exactly perpendicular to the desired starting direction of ball travel. If the clubface at the time its meets the ball is not perpendicular or "square" to the desired direction the typical result will be a missed putt.

To make putting easier, it is known to include alignment lines on either or both of the ball and the putterhead to allow the golfer to properly align the clubface properly in relation to the direction of ball travel. For example, U.S. Pat. No. 4,209,172 to Yamamoto, the disclosure of which is hereby incorporated by reference, teaches a golf ball and a putting club, which each include alignment lines. The ball includes equatorial markings that are at right angles to each other.

U.S. Pat. No. 5,713,799 to Balmat, the disclosure of which is hereby incorporated by reference, discloses a golf ball with two perpendicular lines, one indicating the direction of travel, one indicating the alignment of the putter head.

Other arrangements of alignment lines have also been proposed, but despite the availability of such technologies, golfers still struggle to putt consistently and accurately.

It is an object of the invention to provide a golf putting practice ball that aids the player to position his eyes vertically above the ball at the time of aligning his putt and striking the ball.

It is an object of the invention to provide a golf putting practice ball that aids the player to accurately align the golf ball to the intended direction of travel and align the clubface in proper angle relative to the properly aligned ball.

It is an object of the invention to provide a golf putting practice ball that aids the player to learn to make a putting stroke with appropriate power.

It is an object of this invention to provide an accurate golf putting practice ball that in use will provide immediate visual feedback to the player regarding whether the ball has been properly striken.

It is an object of this invention to provide a golf putting practice ball that helps golfers to become more consistent in putting, which leads to better scores.

Other objects and advantages of this invention will be apparent from the following description considered together with the accompanying drawing.

SUMMARY OF THE INVENTION

The present invention comprises a practice putting golf ball and method adapted to provide the user with significant and useful visual feedback about the user's putting stroke. The golf putting practice ball has two visually contrasting parts of the total surface area, one of lighter color than the other being a darker color or black, and a visually contrasting aiming line located on the lighter color half positioned in 90 degree angle to the border between the two halves of different color, and optionally, a second visually contrasting line located on the lighter colored half running parallel to the aiming line. A visually contrasting mark is located on the equator of the ball at a location 90° away from the aiming line. In other words, for purposes of illustration, if the aiming line is located on the equator of the ball, the visually contrasting mark is located at the "North Pole" of the ball. In the preferred embodiment, a weight is positioned off center totally inside the darker colored half of the ball and axially aligned with the aiming line.

When practicing, a golfer will start by placing the ball on the ground with the aiming line aligned with a line of travel to a hole, and with the visually contrasting mark located on a far side of the ball away from the player; the golfer will position his head over the ball as far as necessary for the golfer to be able to see the visually contrasting mark with the golfer's one eye directly over the ball; and will execute a putting stroke by hitting the ball with the face of the club in 90 degree angle to the aiming line. The golfer can visually detect whether his/her clubface hit the ball squarely by seeing whether the ball keeps rotating with the aiming line maintaining a recurrent positioning at the top of the ball on every rotation while the ball maintains its directional stability. The player will also get a sense of the power used in hitting the ball by viewing the visually contrasting upper and lower sections as they alternately become visible as during ball rotation, creating a slower or faster pulsating impression depending on the power of the putting stroke used. The user then uses the visual feedback to modify his putting stroke, until the user's putting has improved.

BRIEF DESCRIPTION OF THE DRAWINGS

All references in the explanations of the illustrations made to such expressions as left side, right side, top, bottom, upper and/or lower part, front side, striking side, far side and similar descriptions are made based the positioning of a ball on a putting green for use by a right handed player. Additional references to the player's view are taken from the right handed player's position to start his/her putting stroke (addressing the ball) with his/her feet and shoulders approximately perpendicular to the intended line of the putt, with the club head of his/her putting club positioned at the rear side (his/her right side) of the ball, and his/her head directly above the ball.

All drawings are illustrations of the various versions of the ball, all made for a right handed player. Illustrations of the same balls made for left handed players would be mirror images of those described in this patent application.

DESCRIPTION OF THE PREFERRED EMBODIMENTS

Figure 1:
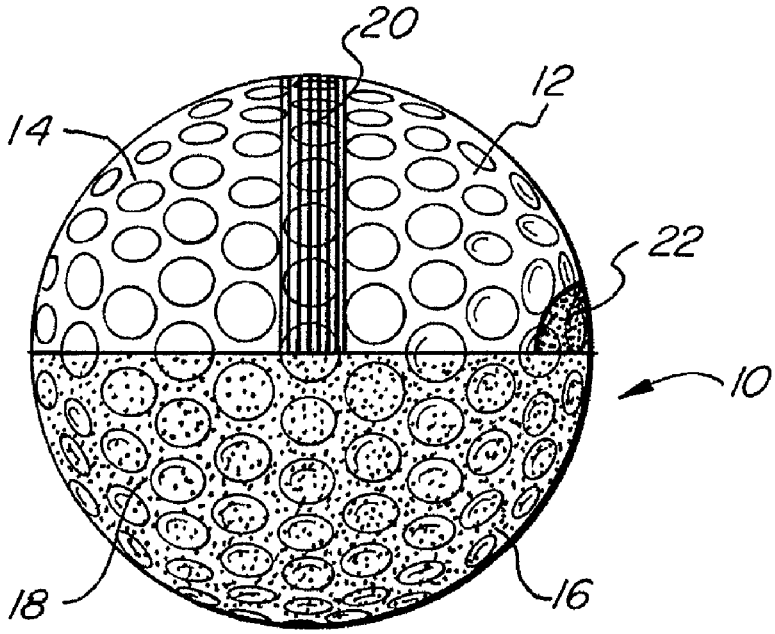
FIG. 1 is a rear elevation view of a first embodiment of a golf putting practice ball in accordance with the invention (the view from the direction from which the clubface hits the ball) (the right side from the player's view), the front elevation view being a mirror image thereof.
Figure 2:
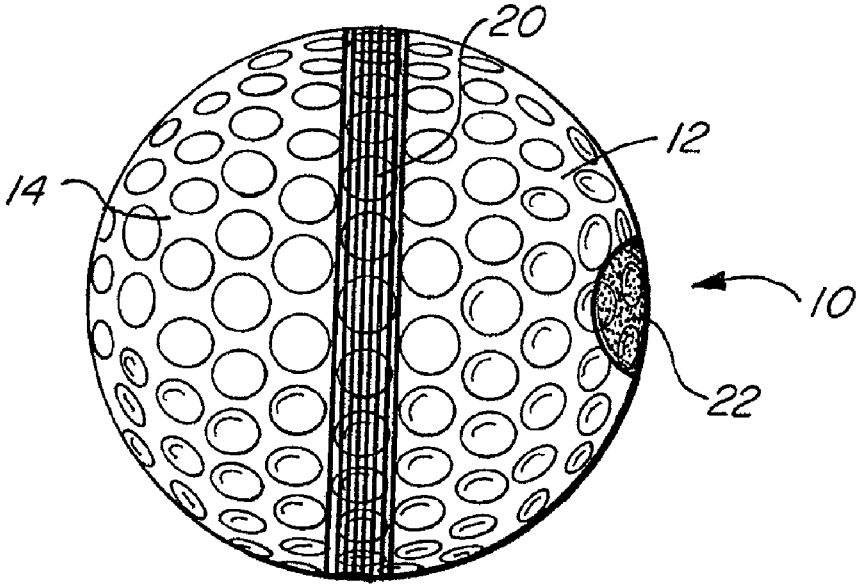
FIG. 2 is a top plan view thereof (the view from above the ball)
Figure 3:
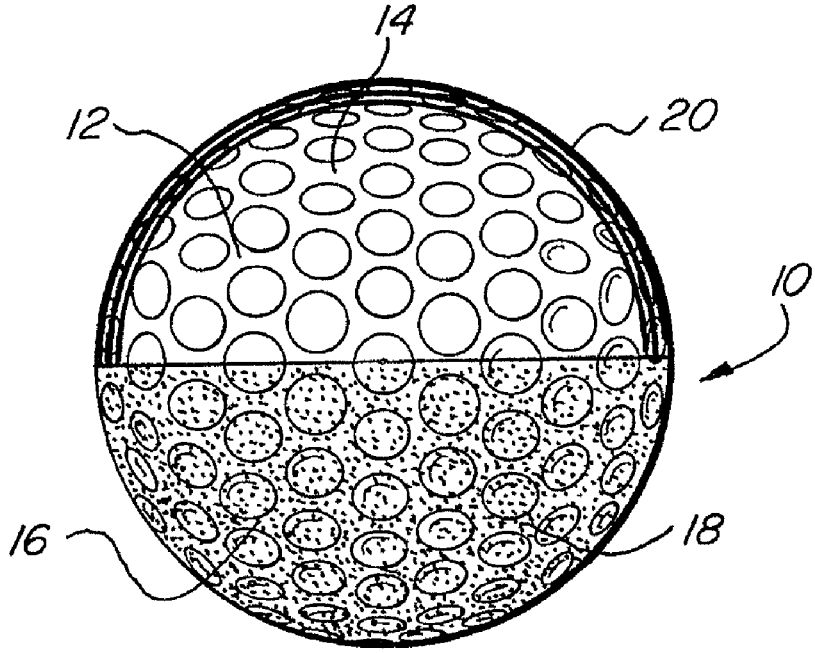
FIG. 3 is a left side elevation view thereof (the near side from the player's view)
Figure 4:
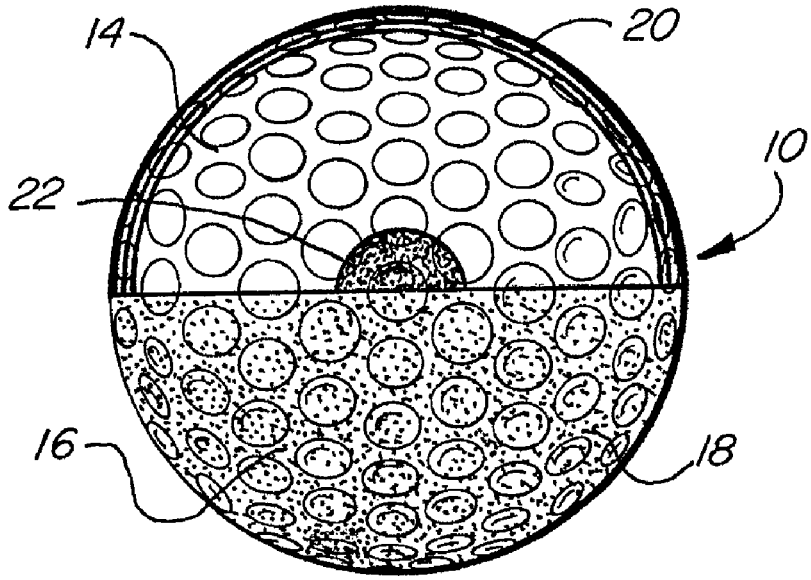
FIG. 4 is a right side elevation view thereof (the far side from the player's view)
Figure 5:
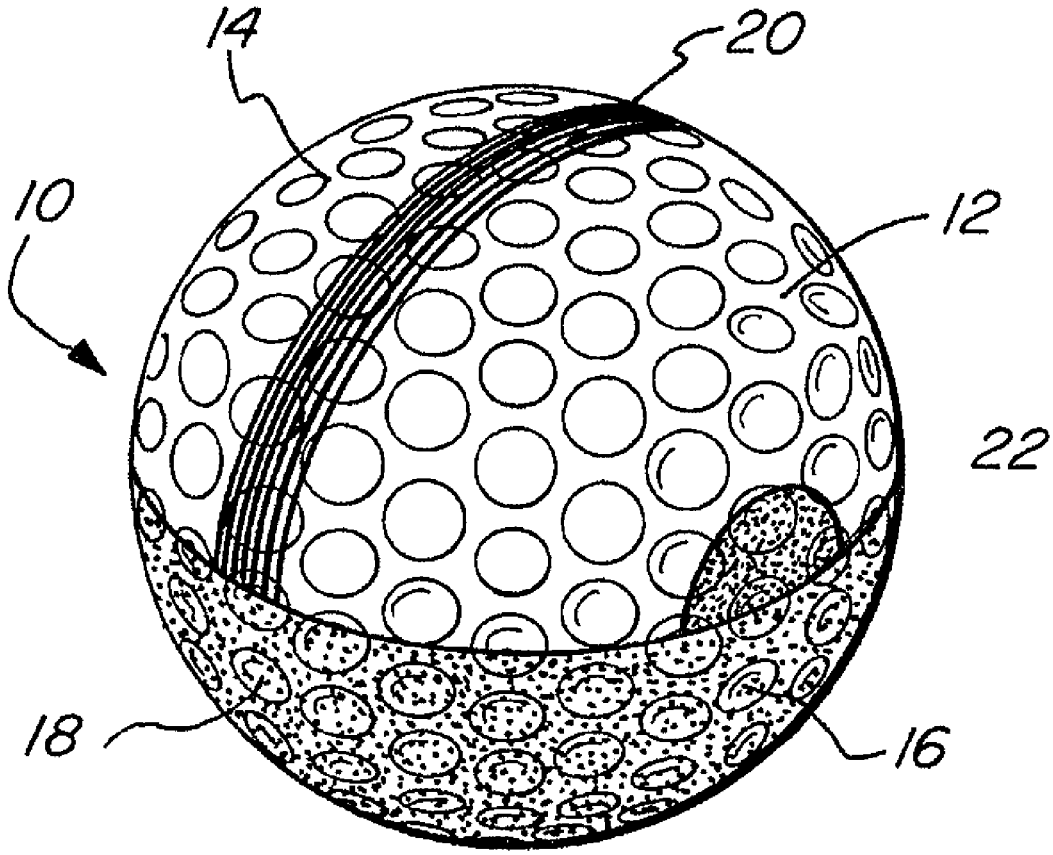
FIG. 5 is a perspective view thereof.
Figure 6:
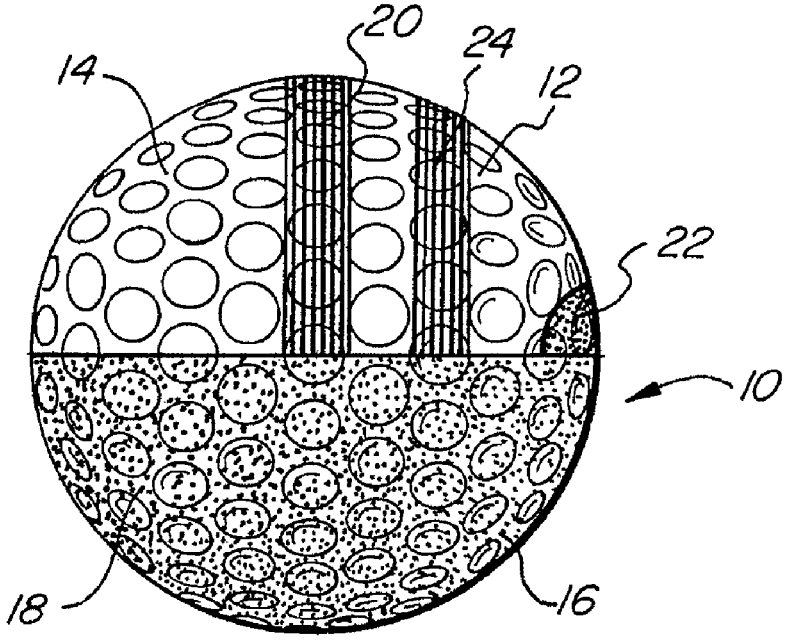
FIG. 6 is a rear elevation view of a second embodiment of a golf putting practice ball in accordance with the invention (the view from the direction from which the clubface hits the ball) (the right side from the player's view), the front elevation view being a mirror image thereof.
Figure 7:
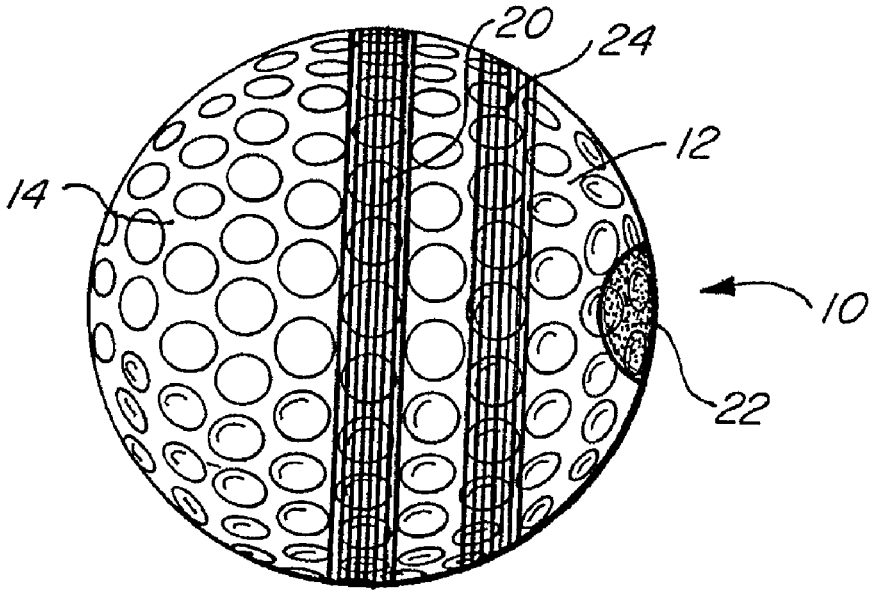
FIG. 7 is a top plan view thereof (the view from above the ball)
Figure 8:
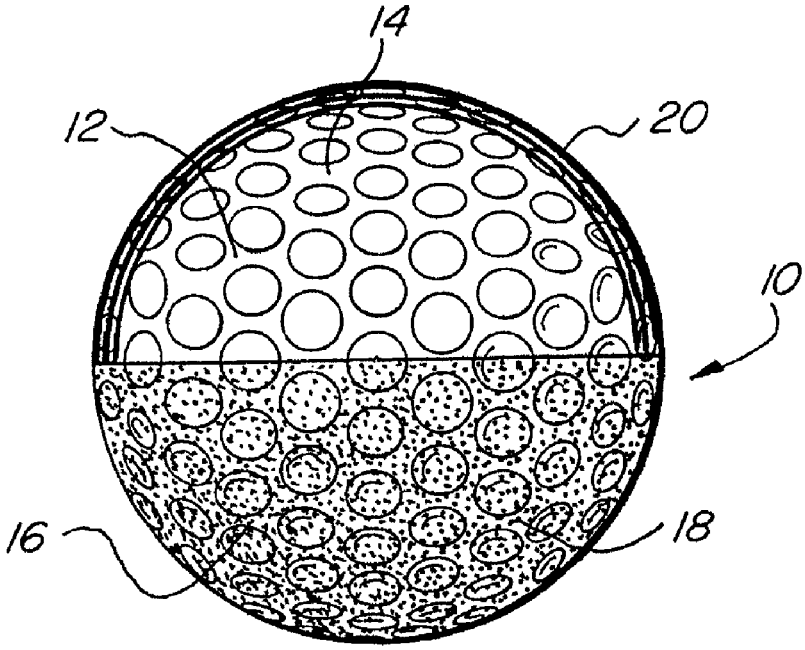
FIG. 8 is a left side elevation view thereof (the near side from the player's view)
Figure 9:
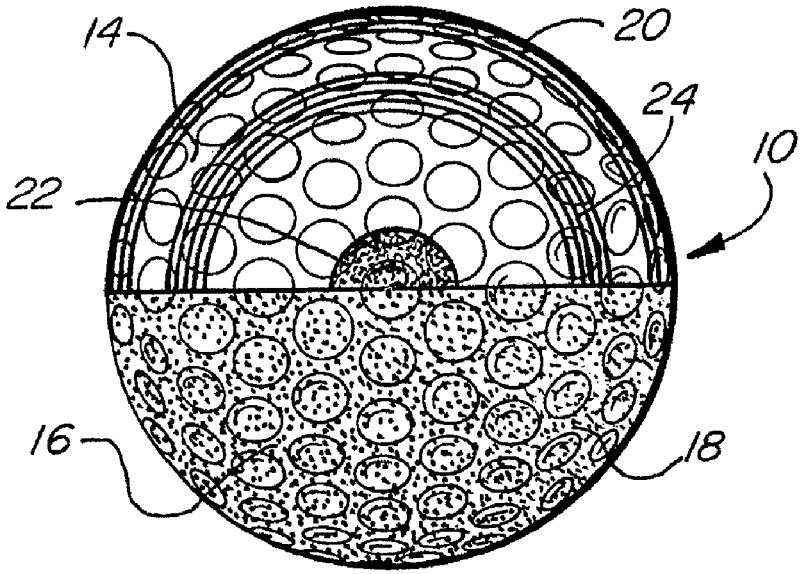
FIG. 9 is a right side elevation view thereof (the far side from the player's view)
Figure 10:
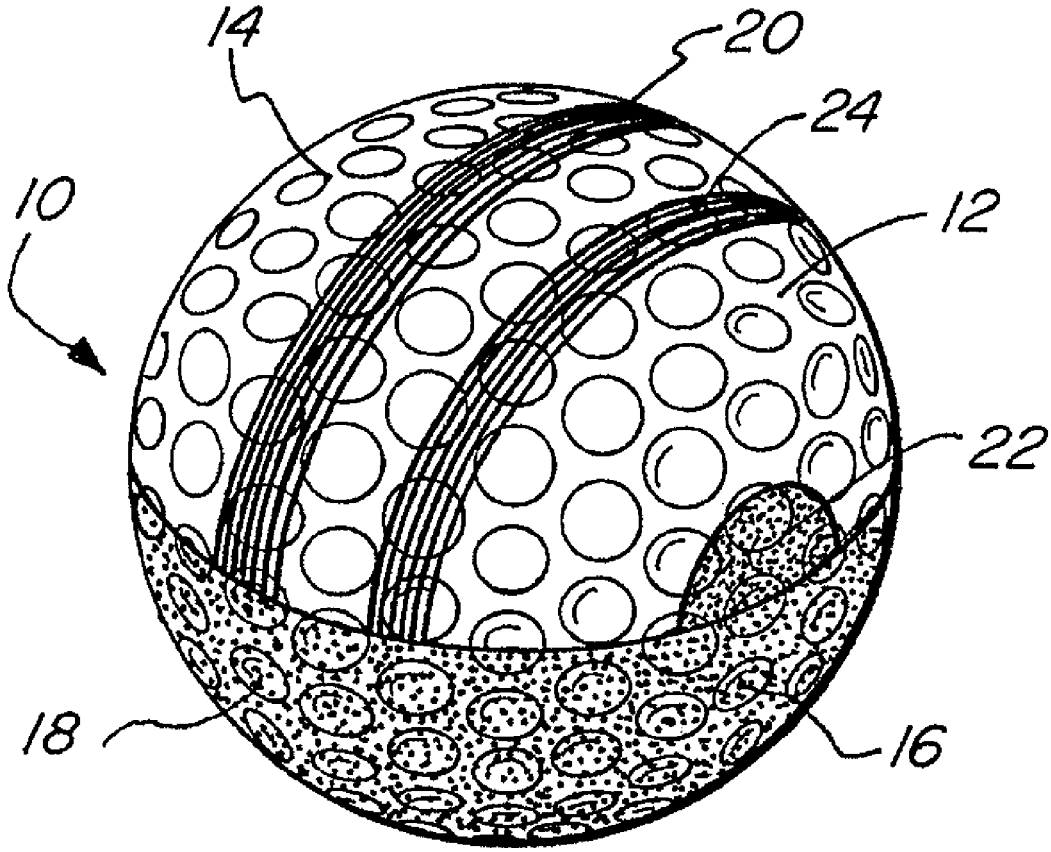
FIG. 10 is a perspective view thereof.
Figure 11:
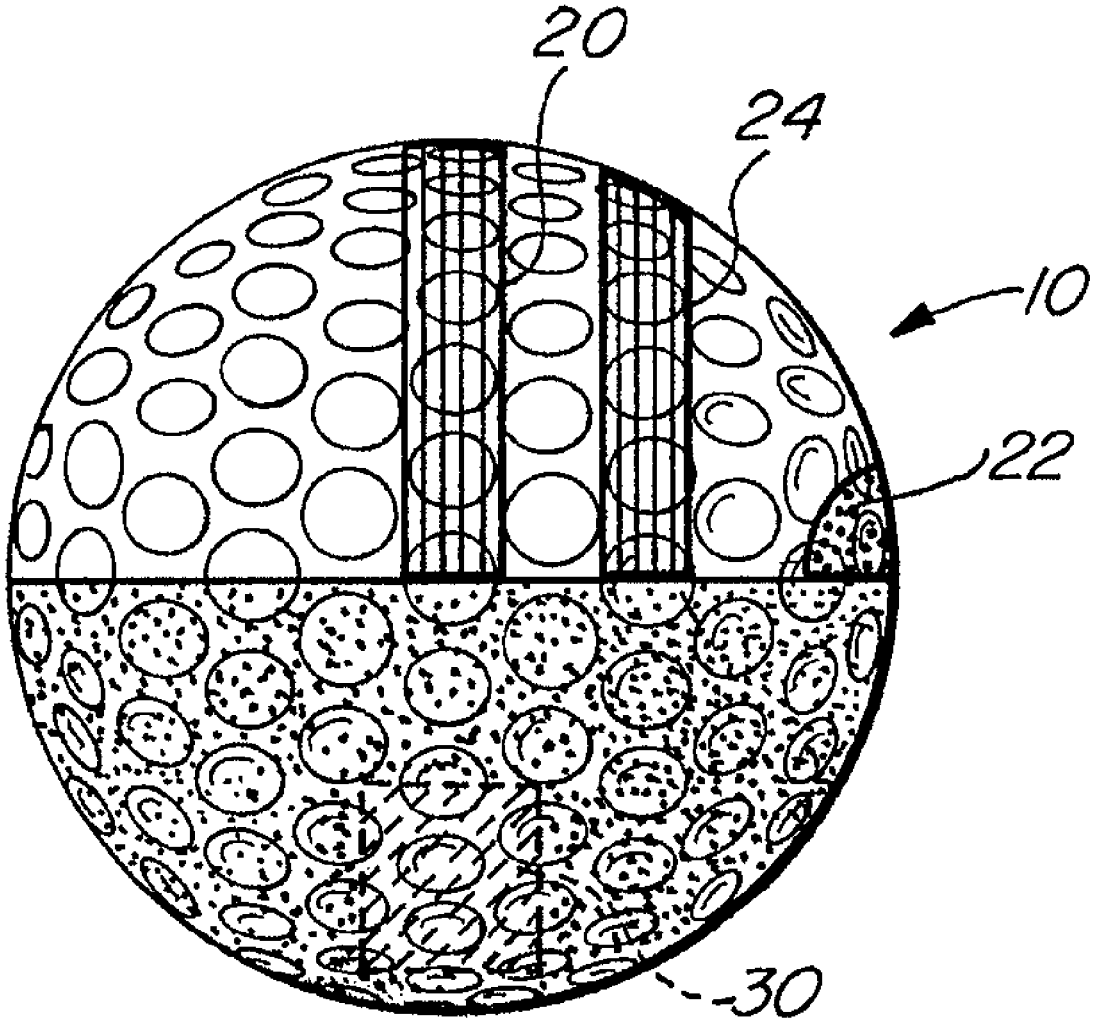
FIG. 11 is a rear elevation view of a third embodiment of a golf putting practice ball in accordance with the invention (the view from the direction from which the clubface hits the ball) (the right side from the player's view) with a weight inside the ball shown in phantom line illustration, the front elevation view being a mirror image thereof.
Figure 12:
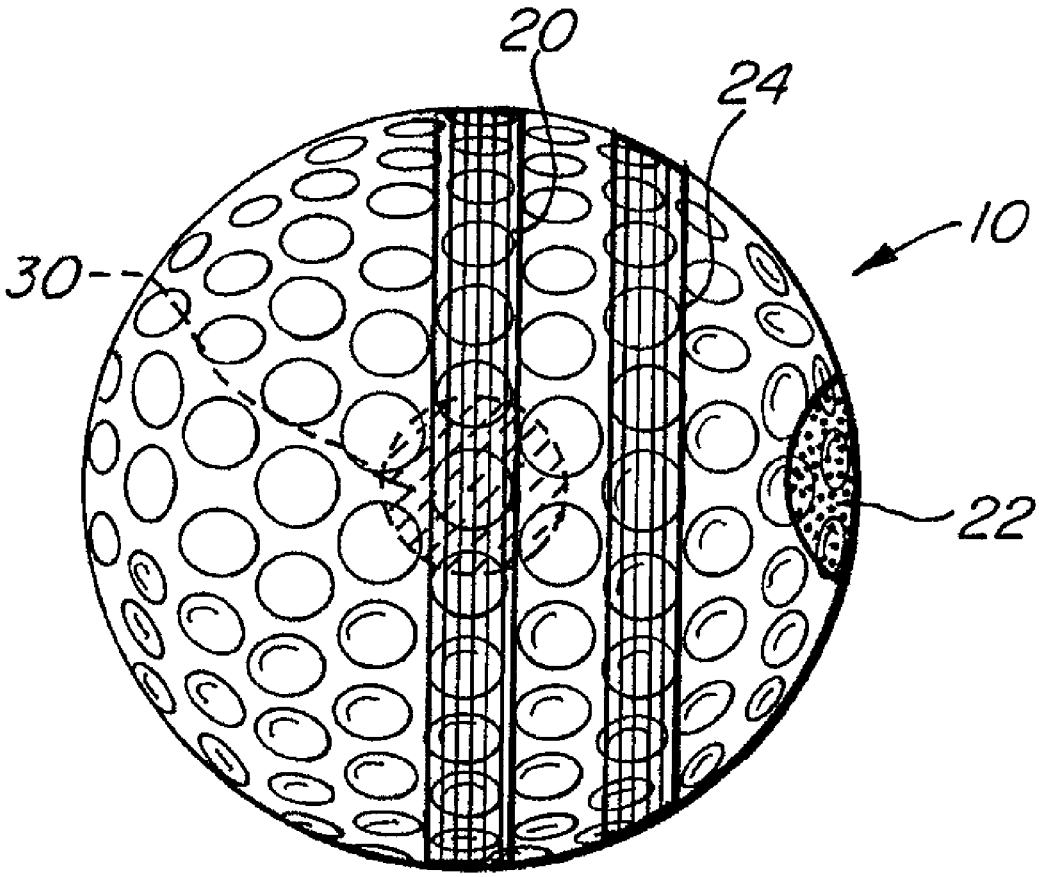
FIG. 12 is a top plan view thereof.

Referring now to FIGS. 1-14, where like elements are indicated with like numbers, a golf putting practice ball comprises a golf ball 10 having its total surface 12 divided in two or more sections of different colors where a section of the upper surface half 14 is of a lighter color than the one or more sections 16 of the bottom half of the surface 18. The lighter color section 12 may consist of the entire surface of the top half of the ball 14 or it may comprise only a portion of the surface of the top half 14. In the same way, the darker section 16 may consist of the entire surface of the bottom half 18 or it may comprise only a portion of the surface of the bottom half 18 of the ball 10.

The section of the surface of the top half 12 and the bottom half 16 of the ball have visually contrasting appearances. In one preferred embodiment, the top section 12 is colored by a light color, and the lower section 16 is of a darker color. In the most preferred embodiment, the upper top section 12 is yellow and comprises the entire surface of the top half of the ball 14, and the bottom section 16 is black and comprises the entire surface of the bottom half 18 of the ball 10. The outer surface of ball 10, including the upper and lower halves of the ball 12 and 16 may have a surface of a variety of textures, and may be same or similar to that of a conventional dimpled golf ball, or it may be smooth, or be combinations of the two or of other surface characteristics.

A visually contrasting aiming line 20 going across the lighter area of the ball on the equator of the ball in the upper surface 12. As can be seen in the Figures, aiming line 20 preferably extends across the lighter color section of the surface of the upper half of the ball in a direction in 90 degree angle to the border between the lighter and darker color sections.

A visually contrasting mark 22 is located on the border between the lighter and darker color sections at a location 90° away from the aiming line 20. Mark 22 may be of any desired shape and is sized to be visible when the ball is viewed from above.

In the second and third embodiments embodiment shown in FIGS. 6-16, a second visually contrasting second aiming line 24 is located on the lighter colored section 14 of the ball parallel to the primary aiming line 20 in the upper surface 12. Visually contrasting mark 22 may be located on the same side of the ball as second aiming line 24. In preferred embodiments, the entire upper surface 12 is of light color, the entire lower surface 16 is black, the primary aiming line 20 is black, the second visually contrasting additional aiming line 24 is black, and the visually contrasting mark 22 is black.

The United States Golf Association specifies a maximum total mass of 45.93 grams for regulation golf balls. In one embodiment, golf ball 10 has a total mass 45.93 grams or less. In one embodiment, the total mass of golf ball 10 is greater than 45.93 grams. For example, the total mass may be between 50 grams and 92 grams. A golf ball 10 with a higher total mass is advantageous because it rotates and travels more slowly, allowing the golfer to count the rotations and discern the exact travel path and rotation of golf ball 10. Furthermore, a higher total mass is advantageous because it gives golf ball 10 higher inertia, providing resistance to the golfer when he/she is hitting the ball with his/her putting stroke. This resistance forces the golfer to have a more powerful putting stroke, primarily with longer follow-through. Practice with a heavier golf ball will train the golfer to have a longer, smoother putting stroke, even when the golfer returns to use a golf ball of a regular weight.

In one preferred embodiment, a weight 30 is embedded in ball 10. Weight 30 is shown in phantom outline in FIGS. 11 and 12, as a cylindrical metal slug. The weight 30 in golf ball 10 slows and accentuates rotation of ball 10 by creating an impression of repetitive pulsation. Weight 30 is axially aligned with the aiming line 20 and located inside the ball completely or predominantly 10 within the lower half 18 of ball 10. The weight 30 can be a dense region, a metal slug, or sand or other material of a weight higher than the average weight of other materials used in the ball. Weight 30 may be installed in the ball during its original manufacturing process or retrofitted in the ball 10 as a step separate from the initial ball molding process. Weight 10 is located inside golf ball 10 and beneath its outer surface. The presence of weight 30 changes the center of mass of the ball, so it is not the same as the geometric center of the ball. In the preferred embodiment, weight 30 is located inside the lower half of the ball, with its axial direction pointing to the mid-point of the primary aiming line, and the axial line of the weight otherwise aligned with the primary aiming line 20

Figure 13:
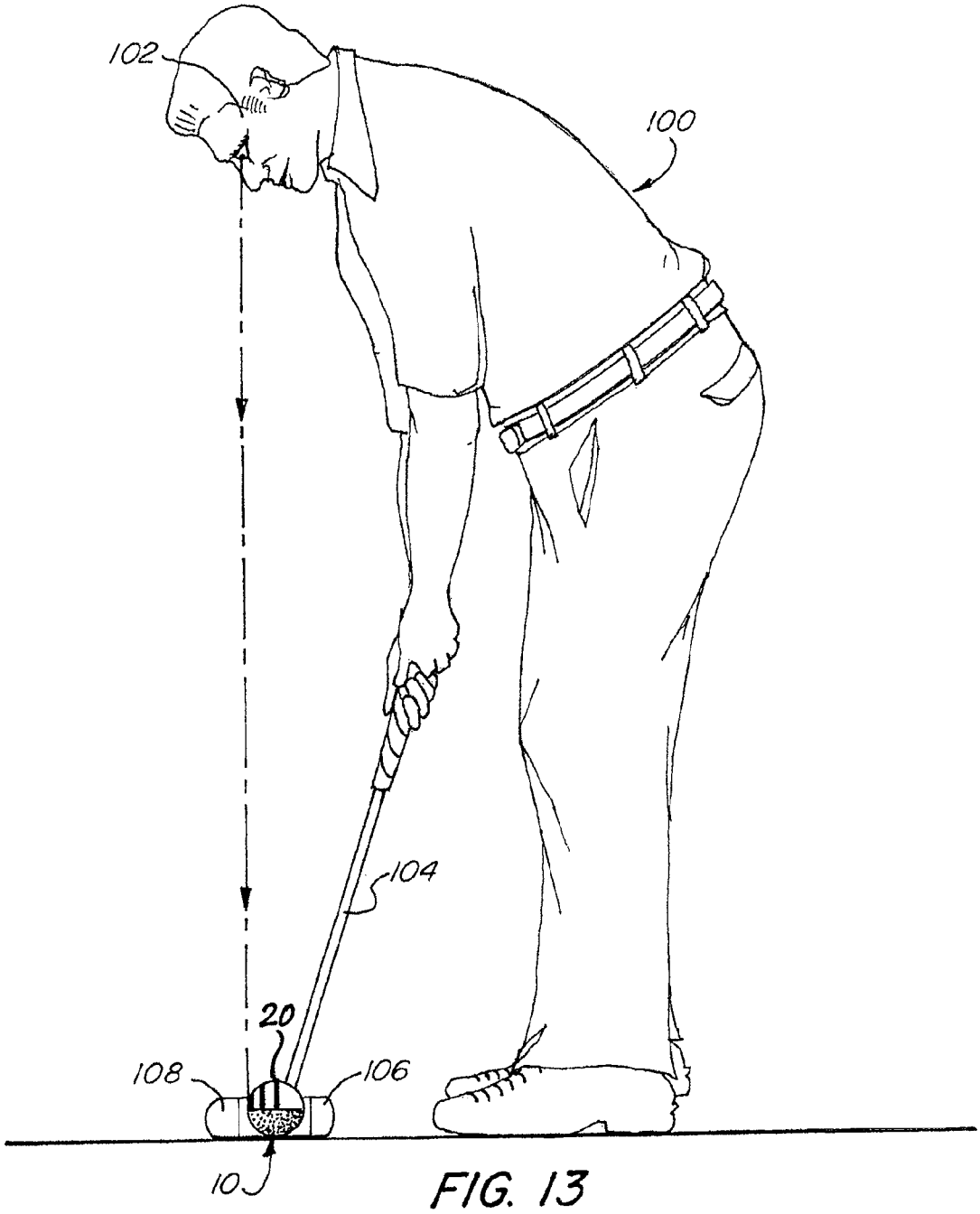
FIG. 13 is a front elevation view of the golf putting practice ball in accordance with the second or third embodiments of the invention (the view from the direction to which the clubface hits the ball) (the left side from the player's view) together with the left side of the golfer in his/her ball addressing position prior to his/her putting stroke.
Figure 14:
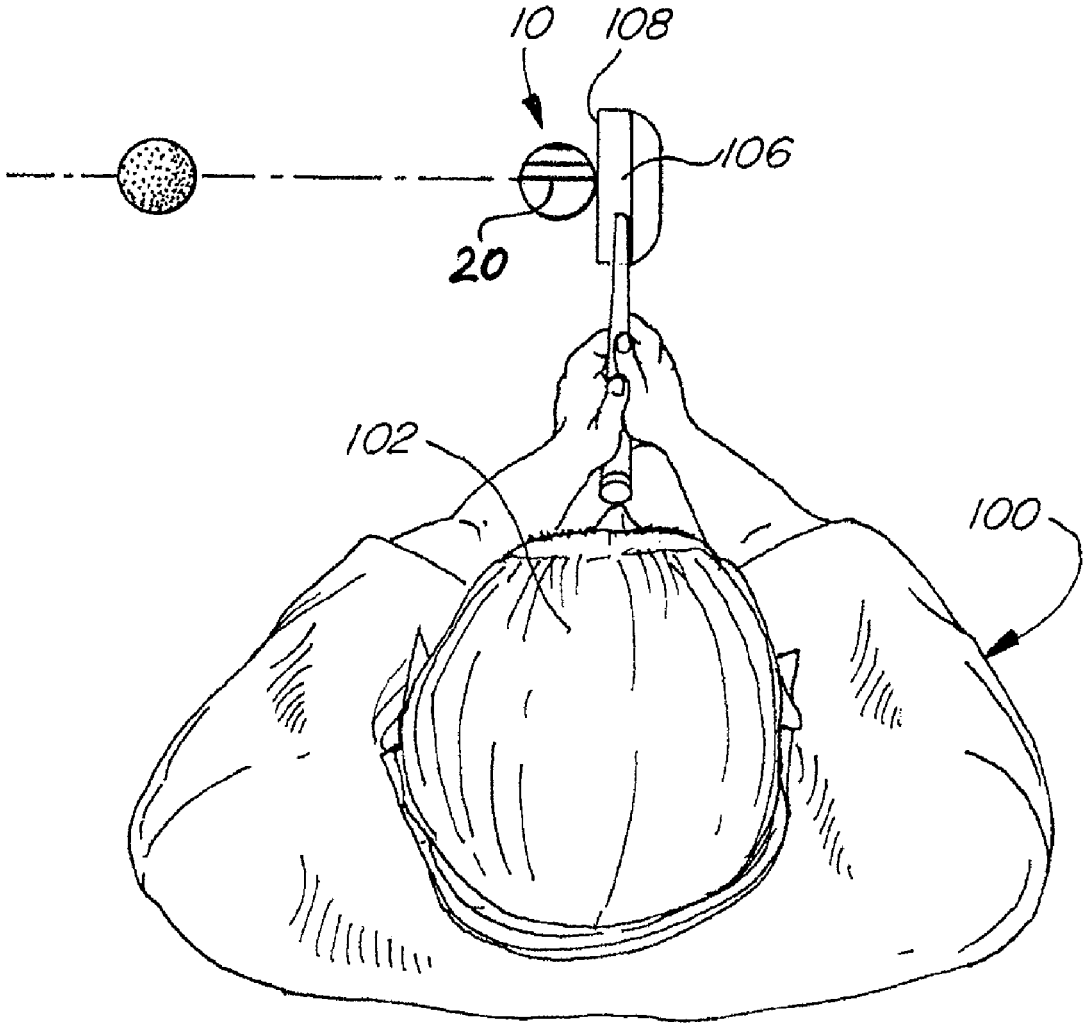
FIG. 14 is a top perspective plan view thereof as seen from above and forward of the golfer, showing the golfer's putter clubface set square to the intended initial direction of the ball.

Methods of golf putting practice using ball 10 are illustrated in FIGS. 13 and 14, the latter figure seen from an angle from a front angle above the player. The ball 10 is positioned on the ground in front of a user 100 with the aiming line 20 aligned with a line of travel to a hole, and the visually contrasting mark 22 located on a far side of the ball away from the player 100. The player is taking his/her position to address the ball before the putt and bends his/her back and neck in a manner bringing his/her head 102 over the ball, with his/her eyes in a vertical line above the 20, his/her eyes over the ball enough to see the visually contrasting mark 22 on the far side of the ball. The user will keep his eyes on the visually contrasting mark 22 and thereby obtain proper eye and body position for striking the putt. In order to see the visually contrasting mark 22 the player needs to lean over to achieve a position in which his/her head is vertically over the ball, while attempting to achieve such a position without (i) the existence of the visually contrasting mark and (ii) the goal of seeing it, would easily be forgotten or ignored. The result is an increase in the accuracy of the putt by reduction of the likelihood of making a putting stroke where the clubface at the impact is not square in relation to the intended initial desired initial direction of the putt.

A practice putt stroke is executed by moving the club 108 in a path which brings the clubface at impact at a 90 degree angle or square to the aiming line 20 so that the putter head 106 hits the ball with the club face 108 perpendicular to the aiming line 20. To improve his/her chances of making a good putt the player keeps his/her head 102 in the position which enables him/her to see the visually contrasting mark 22 from above and keep it there until the follow through part of the putting stroke is completed.

Some putting techniques recommend looking at the hole, instead of the ball, and the present invention can be adapted to those techniques if the initial set up of the shot follows the positioning described above, followed by movement of the head to look at the hole, instead of the ball.

The player 100 visually detects whether his club face 108 hits the ball 10 squarely to provide a correctly aimed putting stroke by determining the degree of directional stability of the primary aiming line 20 (and if present the secondary aiming line 24) while the ball keeps rotating towards its desired direction during the putt. Aiming line 20 and second aiming line 24 provide visual feedback as to the squareness of the putting stroke as the ball 10 rotates. If the putting stroke produces a square impact, the aiming line 20 and second aiming line 24 will appear clear and distinct and remain in a stable directional rotation during the ball's travel. If the putt stroke is not straight and square, aiming line 20 and second aiming line 24 will go off the intended line losing directional stability.

The player 100 also visually detects whether his putter 104 hit the ball with the correct force to provide a correctly powered putting stroke by viewing the visually contrasting upper and lower sections 12 and 16 as they alternately become visible as during repetitive ball rotations. The player 100 can use this visual cue to estimate ball rotation speed. The alternation of the visually contrasting upper and lower sections 12 and 16 provides the user with feedback on the speed of travel and rotation of golf ball 10. The frequency of change between the visually contrasting upper and lower sections 12 and 16 or the visual impression of pulsation is influenced by the rotational speed of golf ball 10. The harder the ball 10 is hit the faster it rotates and the further it travels, and the higher is the frequency of pulsation of the visual impression experienced by the player. The user 100 can even count the rotations of golf ball 10. This allows the player 100 to make more informed adjustments to putting technique in future play for example by learning that only four and a half rotations are necessary for the ball to travel a distance of two feet, a specially scary length of putt to players suffering of putting yips. As a consequence the player may be able change his/her attitude of the degree of difficulty of the two feet long putt by starting to believe that he/or she needs to make the ball to travel in a desired direction only very few rotations, which with this realization no longer would feel difficult at all, and instead as a task mastering of which anybody should be able to learn quickly with the help of the ball of the invention.

Rotation of the heavier version of the practice ball having a mass of between 50 and 92 grams will seem slower than a normal weight ball. The darker coloring of the bottom section magnifies the sense of the ball's slow rotation giving the impression as if the ball would be pulsating. The player therefore learns to focus and see each rotation, initially with a heavier weight ball with slower rotations, then with a standard weight ball showing faster rotations, such that eventually the user can visualize the exact number of rotations necessary for the ball to travel from its starting point all the way to the hole in putts of any given distance. The player can mentally visualize a slow motion video showing every rotation of the ball over its entire path with the last rotation falling into the hole and use this visualization to control how hard to hit his/her putting stroke.

The weight 30 also helps improve swing smoothness and the follow through part of the putting stroke. Since the center of mass of the golf ball in the third embodiment is in a substantially different location than golf ball three dimensional center. Golf ball 10 with weight 30 has an asymmetric rotational pattern. The weighted putting practice ball 10 moves generally slower and travels shorter distance than regular golf balls.

The player will practice with the ball 10 and uses the visual feedback provided by the ball to modify and hone his/her putting stroke, until the his/her's putting has improved.

Although the invention has been described with reference to embodiments herein, those embodiments do not limit the scope of the invention. Modification to those embodiments or different embodiments may fall within the scope of the invention.

The invention claimed is:

1. A golf putting practice ball, comprising:

a golf ball having its surface divided into differently colored parts;

one surface part being a lighter colored part having a visually contrasting straight aiming line extending across the lighter color part of the surface of the ball; and a visually contrasting mark located on a borderline between the different color parts of the surface of the ball at a location 90° away from the aiming line; and a weight which is axially aligned with the aiming line and located in an asymmetric position in relation to a center of the ball.

2. The golf putting practice ball of claim 1, further comprising a second visually contrasting aiming line located on the lighter color surface part parallel to the aiming line between the first aiming line and the visually contrasting mark.

3. The golf putting practice ball of claim 2, wherein the lighter colored part is of a color other than black, a surface part of a different color than the lighter colored part is black, the visually contrasting straight aiming line is black, and the second visually contrasting aiming line is black.

4. The golf putting practice ball of claim 1, wherein the lighter colored part is of a color other than black, a surface part of a different color than the lighter colored part is black, and the visually contrasting straight aiming line is black.

5. The golf putting practice ball of claim 4, wherein the surface part of a different color than the lighter colored part comprises half of the surface of the ball.

6. The golf putting practice ball of claim 1, where the ball has a mass of between 50 grams and 92 grams.

7. The golf putting practice ball of claim 1 further comprising:

a weight which occupies a part of an inside space of the ball located asymmetrically in relation to a center of the ball, the weight's center of mass located inside a half of the ball which is not a half of the ball on which the aiming line is located, the center of the mass of the weight being located on a line which starts from a midpoint of the aiming line and goes through the midpoint of the ball.

8. A golf putting practice ball, comprising:

a golf ball having two or more sections of the surface of the ball of visually contrasting different colors;

one or more of the lighter color surface section(s) having a visually contrasting straight aiming line located at a 90 degree angle to a borderline between sections of different colors;

a second visually contrasting aiming line located in the lighter color surface sections in a direction parallel to the aiming line;

a visually contrasting mark located on the border line between the sections of different colors at a location on a same side of the ball as the second visually contrasting aiming line which is 90° away from the midpoint of the aiming line;

a weight which is axially aligned with the aiming line and located in an asymmetric position in relation to the internal center of the ball.

9. The golf putting practice ball of claim 8, wherein the lighter color section of the ball is of a color visually contrasting to black, the darker color section of the surface is black, the aiming line is black, and the second visually contrasting aiming line is black.

10. The golf putting practice ball of claim 8, where the ball has a mass of between 50 grams and 92 grams.

11. A golf putting practice ball, comprising:

a golf ball having an upper surface and a lower surface;

the upper and lower surfaces having visually contrasting appearances;

the upper surface having a visually contrasting aiming line located along a meridian of the ball; and a visually contrasting mark located on an equator of the ball at a location 90° away from the aiming line.

12. The golf putting practice ball of claim 11, further comprising a second visually contrasting aiming line located on the upper surface parallel to the aiming line.

13. The golf putting practice ball of claim 12, wherein the upper surface is colored, the lower surface is black, the aiming line is black, and the second visually contrasting aiming line is black.

14. The golf putting practice ball of claim 11, wherein the upper surface is colored, the lower surface is black, the aiming line is black, and the visually contrasting mark is black.

15. The golf putting practice ball of claim 11, wherein the lower surface comprises a lower hemisphere of the ball.

16. The golf putting practice ball of claim 11, further comprising: a weight which is axially aligned with the aiming line and asymmetrically located in the ball.

17. A golf putting practice ball, comprising:

a golf ball having an upper surface in its upper hemisphere and a lower surface in its lower hemisphere;

the upper and lower surfaces having visually contrasting appearances;

the upper surface having a visually contrasting aiming line located along the meridian of the ball;

a second visually contrasting aiming line located on the upper surface parallel to the aiming line;

a visually contrasting mark located on the equator of the ball at a location 90° away from the contrasting aiming line;

a weight which is axially aligned with the aiming line and asymmetrically located in the ball within the lower hemisphere of the ball.

18. The golf putting practice ball of claim 17, wherein the upper surface is colored, the lower surface is black, the aiming line is black, and the second visually contrasting aiming line is black.

19. The golf putting practice ball of claim 18, where the ball has a mass of between 50 grams and 92 grams.

* * * * *